United States Patent [19]

Gellerstedt et al.

[11] Patent Number: 4,833,992

[45] Date of Patent: May 30, 1989

[54] FLARE CHARGE INSULATION, A METHOD OF ITS MANUFACTURE AND A FLARE CHARGE MANUFACTURED ACCORDING THERETO

[75] Inventors: Nils Gellerstedt, Karlskoga; Siv Johansson, Degerfors, both of Sweden

[73] Assignee: Aktiebolaget Bofors, Bofors, Sweden

[21] Appl. No.: 53,660

[22] Filed: May 26, 1987

[30] Foreign Application Priority Data

May 23, 1986 [SE] Sweden ..... 860234

[51] Int. Cl.[4] ..... F42B 13/44

[52] U.S. Cl. ..... 102/337; 102/289; 102/290; 264/3.4

[58] Field of Search ..... 102/289-292, 102/334; 264/3.1, 3.4, 3.5

[56] References Cited

U.S. PATENT DOCUMENTS

| | | | |
|---|---|---|---|
| 2,926,605 | 3/1960 | Hammel, Jr. et al. | 102/22 |
| 3,830,156 | 8/1974 | Sewell et al. | 102/22 |
| 3,863,723 | 2/1975 | Godfrey | 102/22 X |
| 4,089,702 | 5/1978 | Enoksson et al. | 102/23 X |
| 4,589,341 | 5/1986 | Clark et al. | 102/303 |

FOREIGN PATENT DOCUMENTS

| | | |
|---|---|---|
| 2629949 | 10/1978 | Fed. Rep. of Germany . |
| 881731 | 11/1961 | United Kingdom . |

*Primary Examiner*—Peter A. Nelson

*Attorney, Agent, or Firm*—Pollock, Vande Sande & Priddy

[57] ABSTRACT

The present invention relates to a novel type of flare charge insulation for retally burning flare charges. The flare charge insulation according to the present invention is produced by compaction of a particulate material or granulate of a mean particle size which does not exceed 1 mm. The major component parts of the granulate are an organic metal salt, and minor amounts of a combustible binder. Moreover, particulate melamine may be included in an amount of up to 20 weight per cent.

The present invention also includes a novel method of producing flare charges in which both the flare charge and flare charge insulation are terminally compacted together to form a continuous unit.

Consequently, the present invention also relates to the finished flare charge manufactured according thereto.

10 Claims, 4 Drawing Sheets

FLARE CHARGE INSULATION, A METHOD OF ITS MANUFACTURE AND A FLARE CHARGE MANUFACTURED ACCORDING THERETO

TECHNICAL FIELD

The present invention relates to a novel type of flare charge insulation for pyrotechnical flare charges, a novel method of manufacturing the flare charge insulation in question, and an externally insulated pyrotechnical flare charge manufactured according thereto.

BACKGROUND ART

Pyrotechnical flare charges, for instance such as are included in parachute flares, are normally provided with external insulation which covers all sides of the flare charge apart from that side which is to be aligned at the target area in question. In this manner, a controlled combustion of the flare charge will be obtained, and the flame is prevented from damaging the parachute disposed above the flare charge. The best possible results will be attained if the properties of the insulation are such that the insulation proper is combusted at the same rate as, or slightly slower than the remainder of the flare charge. Insulation which is too readily combustible will give rise to a total flash-over and rapid flare ignition, with consequently insufficient burning time.

This art has previously seen the employment of different types of thermosetting resin insulations, for example epoxy insulations with coolant and filler additives in the form of, for example, $CaCO_3$ and also asbestos. In order to function as an adequate flare charge insulation, this must first satisfy the requirements of suitable combustion rate, and secondly give the best possible light yield. At the same time, it should not, during its combustin, generate soot or smoke which may obscure or disrupt the flame. One disadvantage which is particularly manifest in the epoxy-based flare charge insulations is that the epoxy group, which is biologically active, is—with all justification—considered as a serious health hazard during the manufacturing phase.

Prior art types of thermosetting resin-based flare charge insulations have been applied to the ready-pressed flare charges by casting in a mould adapted for this purpose. Now that the flare charge insulation according to the present invention has been produced as a semi-manufacture in the form of a fine-grained granulate and not as a castable liquid, the novel flare charge insulation material has entailed requirements of new method for manufacturing the finished flare charge with its associated insulation. Hence, the present invention relates not only to the basic material for a novel type of flare charge insulation, but also to a novel method of producing a pyrotechnical flare charge provided with this novel type of flare charge insulation, and finally, also the finished flare charge with its associated insulation.

SUMMARY OF THE INVENTION

Thus, the flare charge insulation for pyrotechnical flare charges according to the present invention consists of a grained material or granulate which is compacted by pressing to a continuous layer of sufficient strength, the grained material or granulate being of a mean particle size of less than 1 mm and consisting of an organic metal salt, from 1 to 10 weight percent of a combustible binder and possibly up to 20 weight percent of melamine. In this instance, the metal salts preferably consists of sodium oxalate ($Na_2C_2O_4$) or alternatively lithium oxalate ($LI_2C_2O_4$).

A semi-manufacture for the production of the flare charge insulation according to the present invention is thus produced in the form of the particulate metal salt, possibly mixed with the also particulate melamine. According to the invention, the binder is added in the form of a solution in a volatile or fugitive solvent which evaporates during granulation of the particulate material. Suitable binders are certain cellulosic derivatives such as, for instance, ethyl cellulose, or acrylic and vinyl binders such as, for instance, polyethylene vinyl acetate. For example, the binder may be added to the particulate base material dissolved in chlorothene which is then driven off.

Ethylene-vinyl acetate polymer is a highly appropriate binder in this context, not least because the ethylene fraction also functions as a lubricant during the compaction stage of the process.

The advantage inherent in the flare charge insulation according to the present invention is the superior light yield (to which we shall revert below), paired with the capability of controlling the combustion of the pyrotechnical flare charge proper in a desirable manner. As has been pointed out, sodium oxalate and lithium oxalate have proved to be particularly appropriate as basic materials in the flare charge insulation. Other oxalate give a slightly poorer light yield, but, above all, they have proved to possess considerably poorer adhesion to the flare body, which, hence, imparts inferior mechanical properties to the flare charge as a whole.

In accordance with the method according to the present invention, the pyrotechnical flare charge proper is pre-stressed to form a continuous body, wherafter this is placed centered in a press matrix which is slightly larger than the pre-pressed flare charge, whereafter the above-mentioned body is surrounded, on all sides with the exception of that side from which the contemplated combustion is to take effect, by a semi-manufacture of the flare charge insulation according to the invention. Thus, this semimanufacture consists of a free-running granulate of the previously discussed composition. As a final measure, the pyrotechnical flare charge is terminally compacted together with the surrounding flare charge insulation material to form a continuous body. In this phase, the compaction should be so powerful that the insulation material will attain substantially the same degree of homogenity as, for example, a cast and cured epoxy moulding compound.

In the terminal compaction, the flare body undergoes an increase of its relative density from $75 \pm 10$ percent to $>95$ percent.

BRIEF DESCRIPTION OF THE ACCOMPANYING DRAWINGS

The nature of the present invention, as defined in the appended claims, will be more readily understood from the following brief description of the accompanying drawings, with examples, and discussion relating thereto. In the accompanying drawings:

FIGS. 1–3 illustrate the principle involved in the production of a flare body in accordance with the present invention; while FIG. 4 illustrates a light intensity curve for a flare body with the particularly advantageous flare charge insulation accounted for in example 1; and FIGS. 5 and 6 illustrate corresponding values for the flare charge presented in examples 2 and 3, respectively.

DESCRIPTION OF PREFERRED EMBODIMENTS

Figure 1:
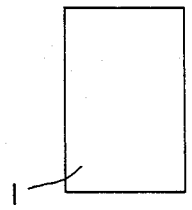
Figure 2:
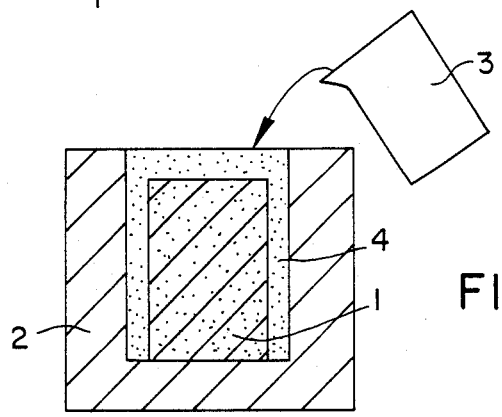

Referring to the drawings, FIG. 1 shows the flare charge powder precompacted to a continuous body 1. In FIG. 2, the body 1 has been placed in a press matrix 2 which is illustrated in crosssection. As reference No. 3 in the figure, the supply is illustrated of the semi-manufacture for the flare charge insulation in the form of a freely-running powder or granulate. Thus, this powder or granulate 4 fills out the press matrix 2 on either side of and above the body 1.

Figure 3:
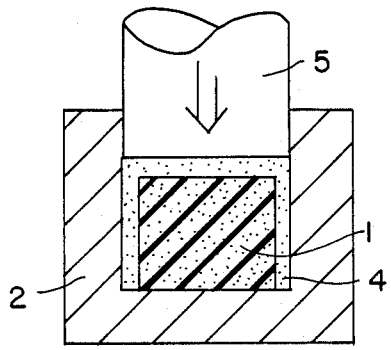

FIG. 3 illustrates the terminal pressing of both the flare charge and the flare charge insulation in a single stage by means of the press mandrel 5.

EXAMPLE 1

Flare charge insulation of the following composition

| | |
|---|---|
| melamine | 10 weight percent |
| sodium oxalate | 85 weight percent |
| ethyl cellulose | 5 weight percent |

To the physical mixture of melamine and sodium oxilate was added the ethyl cellulose dissolved in chloroethene which was wholly driven off during and after the granulation. The thus obtained malamine—solution oxalate granulate had a particle size which substantially lay within the order of magnitude of between 0.1 and 1 mm. In the compaction of the freely-running particulate semi-manufacture, its total volume was reduced by 45±10 percent.

Figure 4:
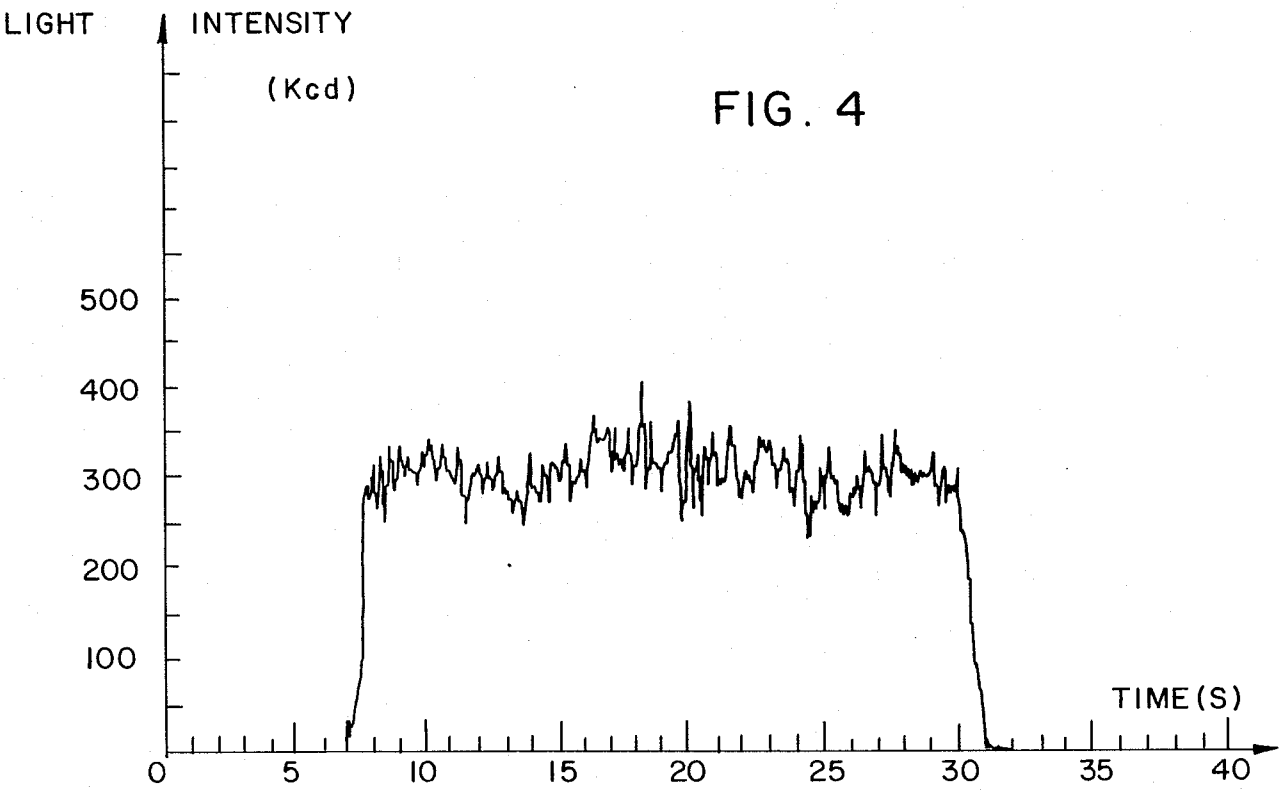

In the sample illustrated in FIG. 4, the flare charge proper consisted of a 100 g charge of the type described in Swedish Patent Specification No. 345.845, i.e. it consisted of magnesium up to approximately 55 weight percent and sodium nitrate up to approximately 40 weight percent and a minor amount of binder. The combustion cycle was characterised by a uniform combustion and an intensely glowing flame without disruptive smoke generation.

EXAMPLE 2

Flare charge insulation of the following composition:

| | |
|---|---|
| Lithium oxalate | 95 weight percent |
| Ethyl cellulose | 5 weight percent |

Figure 5:
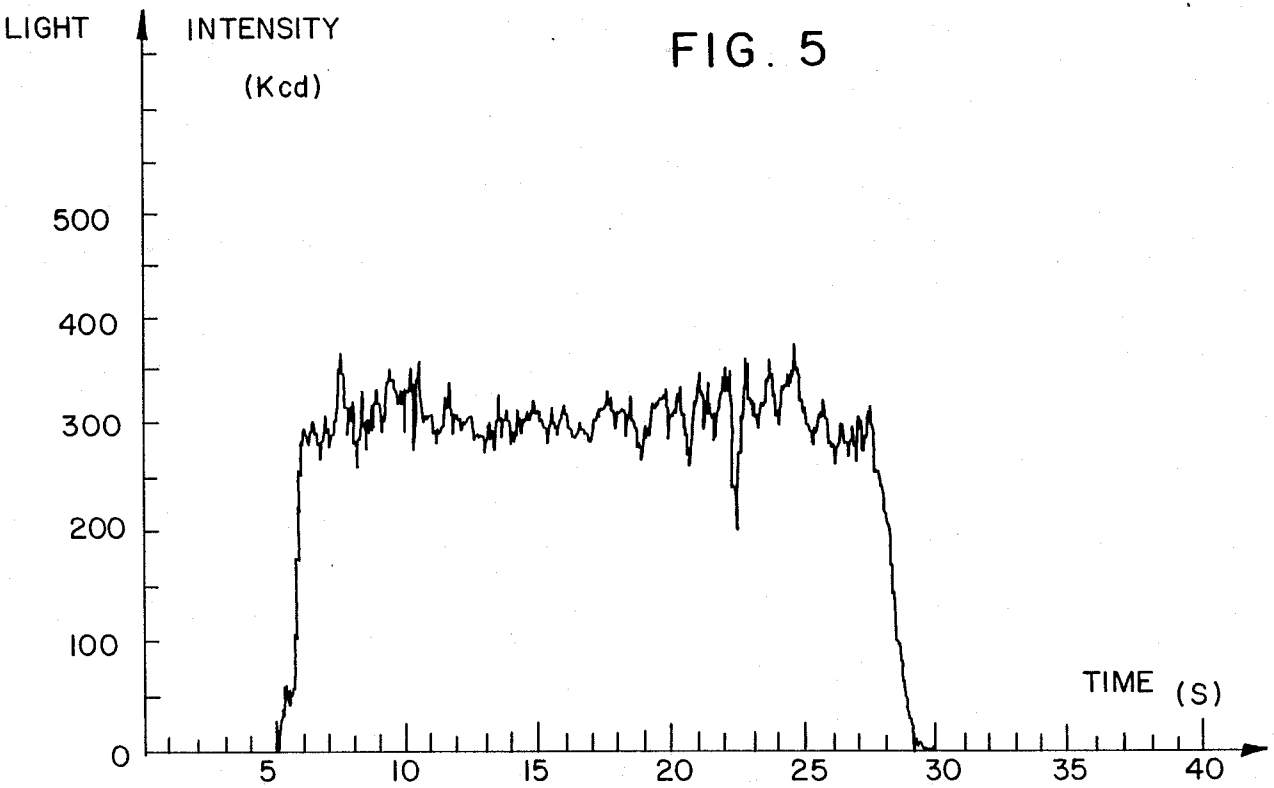

The binder was added in the same manner as in example 1 and both production and testing were carried out in the same manner as in this previous example. The experiment result is presented in curve form on FIG. 5. The particle size of the lithium oxilate was of the order of magnitude of between 0.005 and 0.1 mm. The size of the flare charge was also 100 g in this case. As was apparent from FIG. 5, the flame obtained gave a high light generation performance and a uniform combustion.

EXAMPLE 3

Flare charge insulation of the following composition:

| | |
|---|---|
| Sodium oxalate | 95 weight percent |
| Polyethylene vinyl acetate | 5 weight percent |

Figure 6:
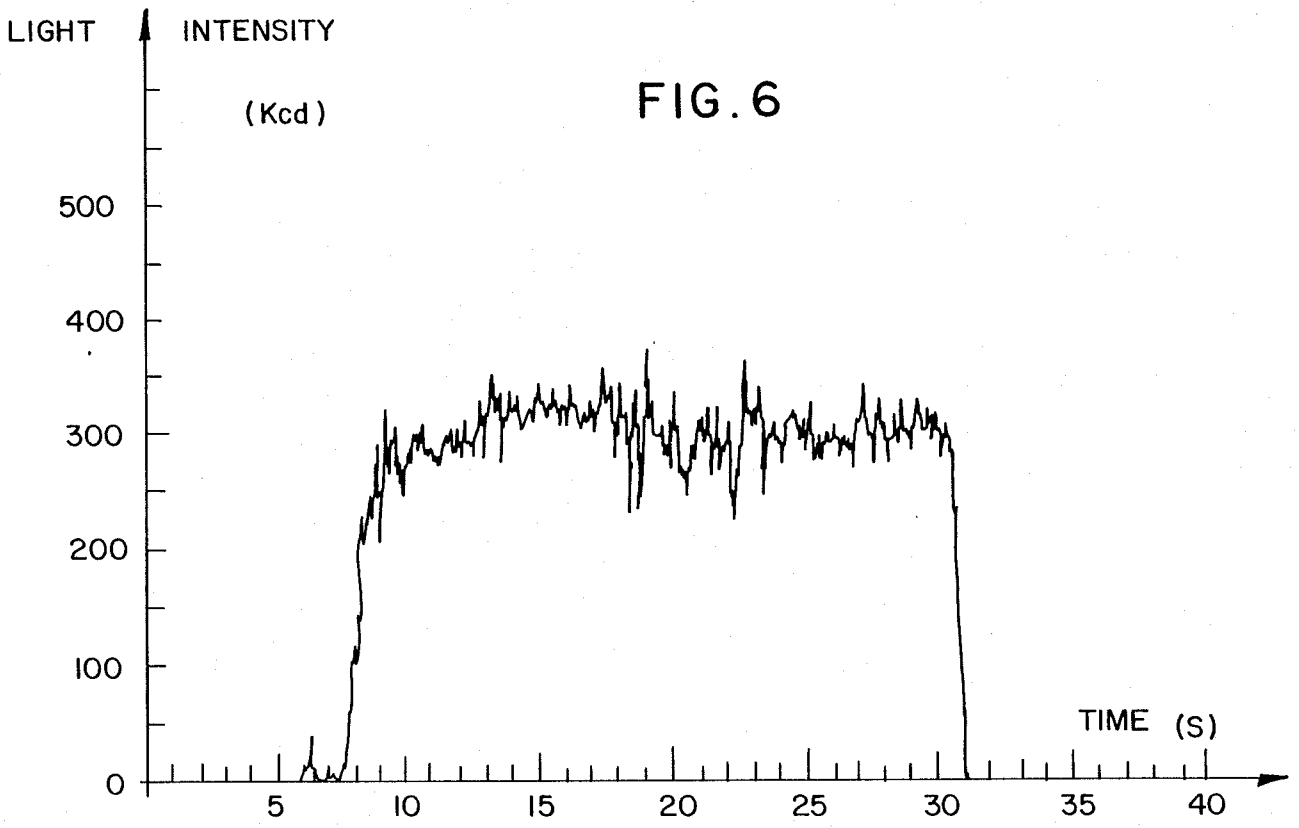

The trial samples were produced in the same manner as in the two proceeding examples. The particle size of the sodium oxalate was of the order of magnitude of between 0.01 and 1.0 mm and the weight of the flare charge was also 100 g in this case. The light intensity curve obtained on testing is apparent from FIG. 6.

What we claim and desire to secure by Letters Patent is:

1. A flare charge insulation for retally-burning pyrotechnical flare charges characterized in that it consists of a particulate material or granulate which is compacted by pressing to form a continuous layer, said particulate material or granulate having a mean particle size not exceeding 1 mm, and consisting of an organic metal salt, from 1–10 weight percent of a combustible binder, and 0 to 20 weight percent of melamine and wherein said organic metal salt includes sodium oxalate ($Na_2C_2O_4$), or lithium oxalate, or mixtures thereof.

2. The flare charge insulation as claimed in claim 1, characterized in that it includes from 70 to 90 weight percent of sodium oxalate or lithium oxalate or mixtures, up to 10 weight percent of binder, and 0 to 20 weight percent of melamine.

3. The flare charge insulation as claimed in claim 2, characterized in that the included binded is of the cellulosic type, the acrylic type, or vinyl type.

4. The flare charge insulation as claimed in claim 2 or 3, characterized in that it consists of a physical mixture, compacted by pressing to the same homogenity as moulded epoxy, or 10 weight percent of malamine of an original particle size of the order of magnitude of between 0.005 and 1.0 mm, 85 weight percent of particulate sodium oxalate of the corresponding particle size, and 5 weight percent of ethyl cellulose vaporized onto the melamine and sodium oxalate particles prior to the compaction.

5. A method of producing a pyrotechnical flare charge provided with a flare charge insulation according to claims 1, 2, or 3, characterized in that the pyrotechnical flare charge proper is, after precompaction to form a continuous body, placed centered in a press matrix which is wider than the body in question, and is thereafter surrounded, on all sides with the exception of that side from which the contemplated combustion is intended to take effect, by a flare charge insulation material in the form of a freely-running powder or granulate consisting of an organic metal salt in which the particle size of the powder or granulate does not exceed 1 mm, up to 20 weight percent of pulverous melamine of a corresponding particle size as the metal salt, and from 1–10 weight of a combustible binder which is vaporized beforehand onto the pulverous particles with the assistance of a volatile or fugitive solvent, whereafter the flare charge proper, with the surrounding flare charge insulation material, are compacted together until both the flare charge material and the flare charge insulation material have attained the desired degree of density and strength.

6. The method as claimed in claim 5, characterized in that the terminal compaction of the flare body with the flare charge material and insulation material included therein is sustained until an increase of the relative density from 75±10 percent to up to 95 percent is achieved.

7. A flare charge produced according to claim 5, characterized in that its pyrotechnical flare charge compacted by pressing is surrounded by a physical mixture which is formed similarly by compaction into a continuous coating and which comprises between 70 and 95 weight percent of sodium oxalate, or lithium oxalate or mixtures, between 1 and 10 weight percent of a binder of the acrylic or vinyl type, and up to 20 weight percent of melamine.

8. A flare charge produced according to claim 6, characterized in that its pyrotechnical flare charge compacted by pressing is surrounded by a physical mixture which is formed similarly by compaction into a continuous coating and which comprises between 70 and 95 weight percent of sodium oxalate, or lithium oxalate or mixtures, between 1 and 10 weight percent of a binder of the acrylic or vinyl type, and up to 20 weight percent of melamine.

9. The flare charge insulation of claim 4 wherein said binder includes ethyl cellulose.

10. The flare charge insulation of claim 4 wherein said binder includes ethylene-vinyl acetate polymer.

* * * * *